United States Patent [19]

Aono

[11] 4,402,291

[45] Sep. 6, 1983

[54] EMISSION CONTROL APPARATUS FOR INTERNAL COMBUSTION ENGINES USING AN AMPLITUDE MODULATED SIGNAL

[75] Inventor: Shigeo Aono, Tokyo, Japan

[73] Assignee: Nissan Motor Company, Ltd., Yokohama, Japan

[21] Appl. No.: 20,128

[22] Filed: Mar. 13, 1979

Related U.S. Application Data

[63] Continuation of Ser. No. 753,796, Dec. 23, 1976, abandoned.

[30] Foreign Application Priority Data

Dec. 27, 1975 [JP] Japan ..... 50-155775

[51] Int. Cl.[3] ..... F02B 33/00; F02M 7/00

[52] U.S. Cl. ..... 123/440; 123/489; 60/285; 60/276

[58] Field of Search ..... 123/32 EF, 119 EC; 60/285, 276

[56] References Cited

U.S. PATENT DOCUMENTS

| | | | |
|---|---|---|---|
| 3,676,782 | 7/1972 | Lane | 328/1 |
| 3,782,347 | 1/1974 | Schmidt et al. . | |
| 3,827,237 | 8/1974 | Linder | 123/32 EE |
| 3,875,907 | 4/1975 | Wessel | 123/32 EE |
| 3,900,012 | 8/1975 | Wahl | 123/32 EE |
| 4,287,865 | 9/1981 | Seitz | 123/440 |

OTHER PUBLICATIONS

"Signal Stabilization"... by Rufus Oldenberger, ASME Transactions, 11/75, pp. 1869–1872.

*Primary Examiner*—Ronald B. Cox

*Attorney, Agent, or Firm*—Schwartz, Jeffery, Schwaab, Mack, Blumenthal & Koch

[57] ABSTRACT

Emission control apparatus for a multi-cylinder internal combustion engine has an exhaust composition sensor disposed in a passage in common to the exhaust systems of the engine. The sensed concentration of the exhaust composition is modulated in amplitude by a bipolar pulsating signal at a frequency higher than the frequency of the sensed exhaust concentration. A statistical analysis indicates distribution of the ratios within a narrow stoichiometric window.

8 Claims, 4 Drawing Figures

EMISSION CONTROL APPARATUS FOR INTERNAL COMBUSTION ENGINES USING AN AMPLITUDE MODULATED SIGNAL

This is a continuation of application Ser. No. 753,796 filed Dec. 23, 1976, now abandoned.

FIELD OF THE INVENTION

The present invention relates to closed-loop emission control apparatus for multi-cylinder internal combustion engines wherein a sensed exhaust composition is forcibly fluctuated in amplitude at a frequency higher than the oscillation frequency of the control loop due to its inherent delay time so that most of statistically sampled air-fuel ratios distributes within a narrow stoichiometric window.

BACKGROUND OF THE INVENTION

In a closed-loop emission control apparatus wherein an exhaust composition is sensed to control the air fuel ratio with the sensed concentration of the exhaust composition, control oscillation is inevitable because of the inherent delay time involved in the cylinder cycles. As a result of the oscillation, air-fuel ratios tend to deviate greatly from the desired point (stoichiometry) and the residence time of the mixture outside of the stoichiometric window may prolong. According to a statistical analysis in which air fuel ratios are sampled and their occurrences are plotted, the sampled values form a distribution over a wide range of mixtures. From the emission control standpoint it is desirable that the sampled values distribute within a narrow stoichiometric window since noxious compositions (NOx, HC and CO) are simultaneously chemically converted into harmless materials at a maximum efficiency when the mixture is controlled in the neighborhood of the stoichiometry.

SUMMARY OF THE INVENTION

An object of the present invention is to provide emission control apparatus for internal combustion engines in which air-fuel ratios are controlled within a narrow stoichometric window under any operating condition of the engine.

Another object of the invention is to provide emission control apparatus in which the concentration of an exhaust composition is sensed to provide a control signal representative of the extent of deviation from a predetermined setting value and wherein a bipolar signal is used to modulate the amplitude of the control signal so that it fluctuates or oscillates at a higher frequency than the frequency of the control oscillation.

The modulated control signal is caused to cross the zero voltage level many times within a period of control oscillation. This results in a sensed concentration having a value approaching the stoichiometric point. In accordance with the invention, a single exhaust composition sensor is provided for a plurality of exhaust systems of the engine and thus the sensed exhaust concentration represents a value of mixture ratios of the cylinders combined at a given instant of time, rather than a mixture value of a particular cylinder. The result is an output from the exhaust sensor which does not sharply respond to rapid changes of control signal amplitude. By the fluctuation of the control signal at a high frequency, the sensed exhaust concentration assumes substantially a mean value of the air-fuel ratios of the cylinders at a given instant of time. This averging effect tends to prevent air fuel ratios from becoming too rich or too lean even though the engine encounters a sudden change of load.

A further object of the invention is therefore to provide emission control apparatus for multi-cylinder internal combustion engine having a single exhaust composition sensor in common to the exhaust systems in which an averaging effect of the sensor is utilized to concentrate air-fuel ratios within a narrow stoichiometric window.

A still further object of the invention is to prevent air-fuel ratios from becoming too rich or too lean under transient engine load conditions.

A still further object of the invention is to minimize the amount of noxious emission components under various engine operating conditions.

Another factor that influences the concentration of the sampled air fuel ratios within the intended range is a control circuit which provides both proportional amplification and integration of a signal representing the sensed concentration of the exhaust composition. The sampled control signals will form a distribution having its peak at the stoichiometric point, which in turn causes many of the sampled air fuel ratios to be concentrated within the stoichiometric window when the control circuit is used in combination with the modulation scheme as described above.

Therefore, a still further object is to provide emission control apparatus having a proportional and integration control of the sensed exhaust composition in combination with the modulated control signal.

BRIEF DESCRIPTION OF THE DRAWINGS

These and other objects, features and advantages of the invention will be understood from the following description taken in conjunction with the accompanying drawings, in which.

DESCRIPTION OF THE PREFERRED EMBODIMENT

Figure 1:
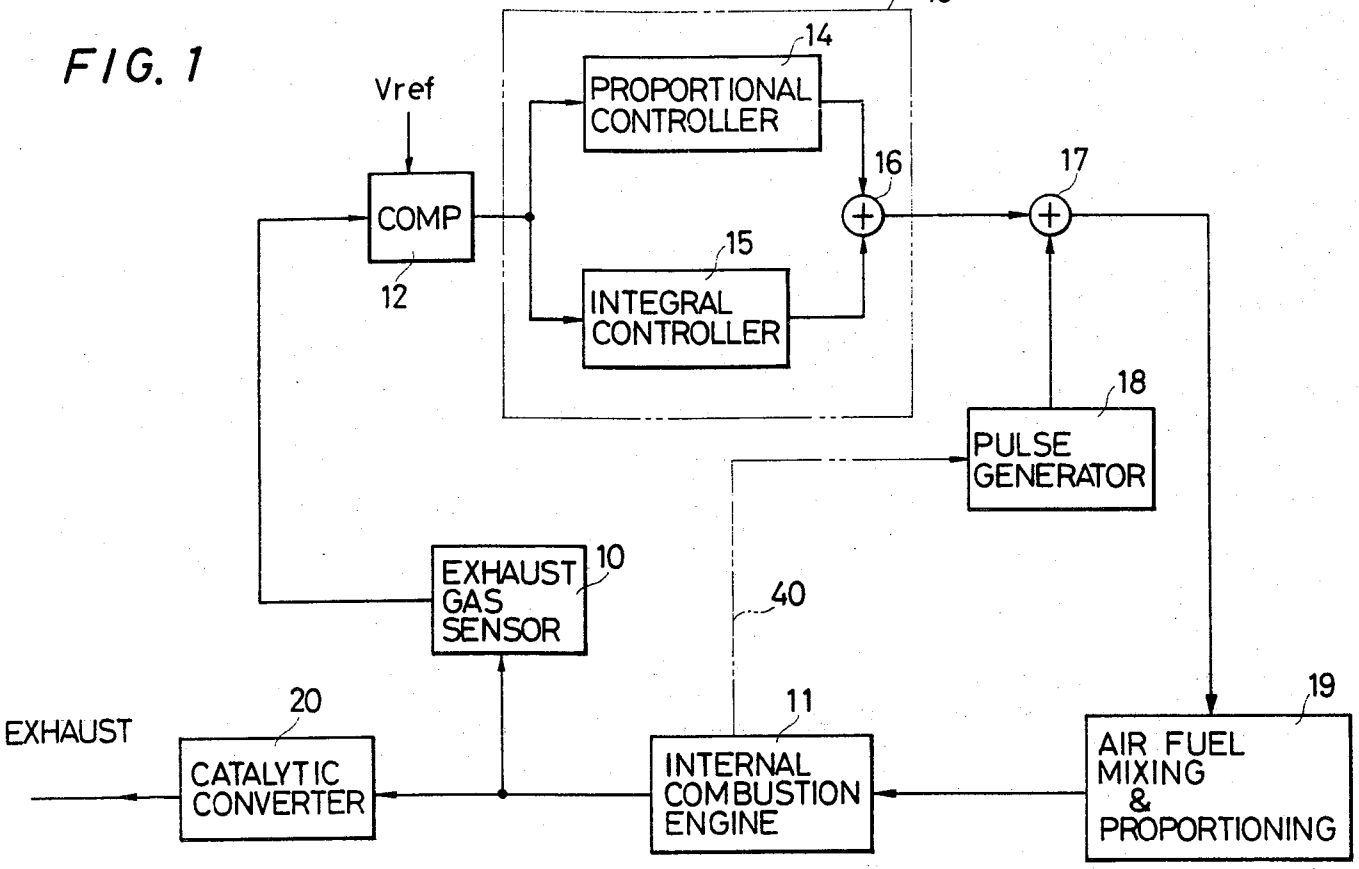
FIG. 1 is a schematic circuit diagram of a preferred embodiment of the invention.
Figure 2A:
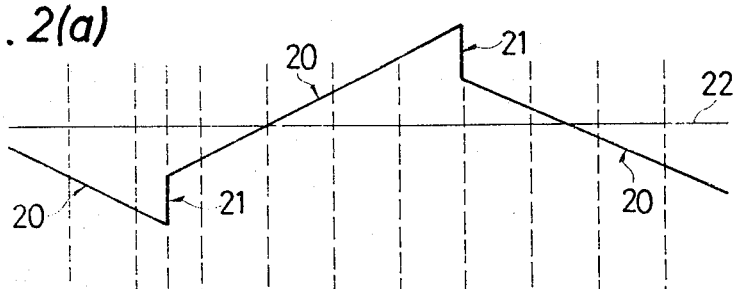
FIG. 2 is a graphic illustration of various waveforms appearing in the circuit of FIG. 1.
Figure 2B:
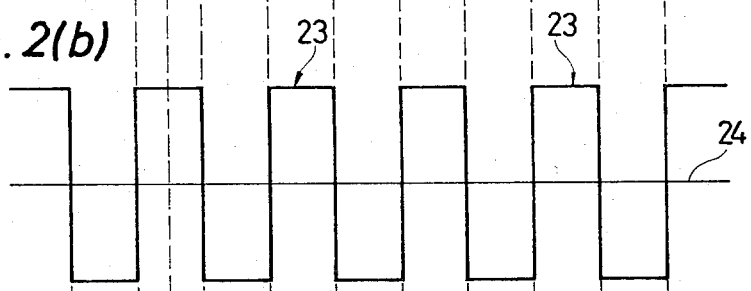
Figure 2C:
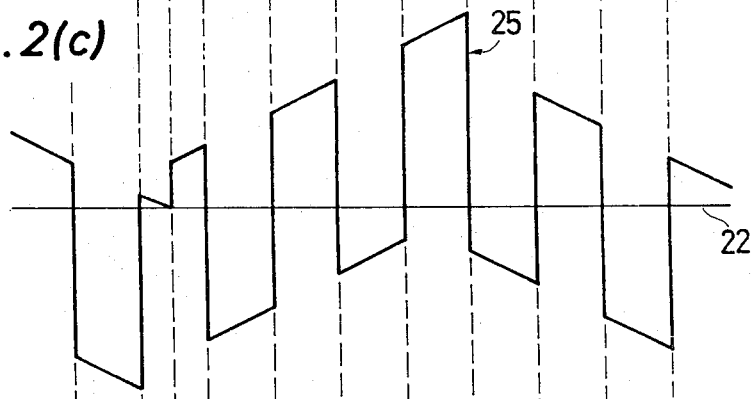
Figure 2D:
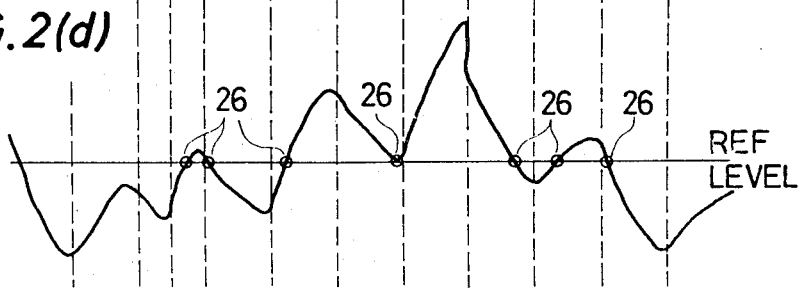
Figure 3A:
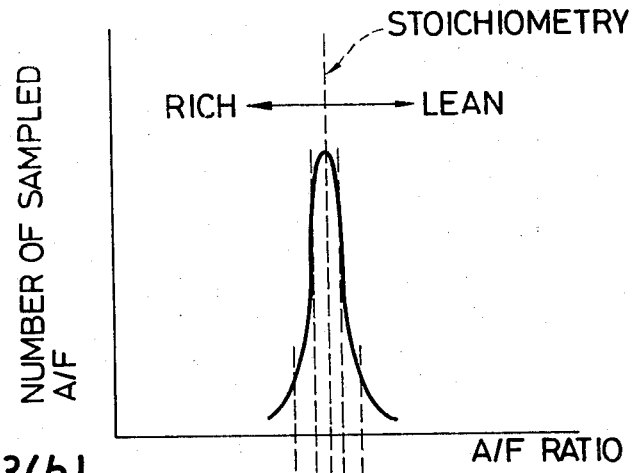
FIG. 3 is a statistical analysis showing distributions of control signals and air fuel ratios, and the relationship therebetween.
Figure 3B:
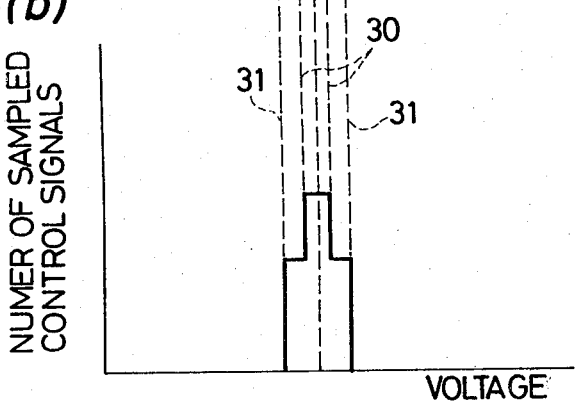

In FIG. 1 emission control apparatus for a multi-cylinder internal combustion engine according to the present invention is illustrated as comprising an exhaust gas sensor 10 disposed in the exhaust passage of the internal combustion engine 11 to detect the concentration of an exhaust composition, oxygen for example, in the emissions to generate an output having a sharp characteristic change in amplitude in the neighborhood of the stoichiometry of the air-fuel mixture. Such output characteristic is provided by a conventional zirconium type oxygen sensor wherein the output is high in amplitude at air-fuel ratios smaller than stoichiometric (richer mixture) and low in amplitude at ratios greater than stoichiometry (lean mixture).

The output of the exhaust gas sensor 10 is connected to a comparator 12 for comparison with a reference voltage to provide a positive or negative voltage output depending upon whether the sensed oxygen concentration is above or below a predetermined air-fuel ratio (stoichiometric value, for example, when catalytic converter is tuned to provide simultaneous reduction of noxious components NOx, HC and CO) represented by the reference voltage.

The comparator output is applied to a control circuit 13 which preferably comprises a proportional controller 14 and an integral controller 15. The proportional controller 14 may be a DC amplifier which provides proportional amplification of the input signal applied thereto and the integral controller 15 provides linear integration of the input signal applied thereto. The outputs from the controllers 14 and 15 meet at a summation point 16 at which both input signals are added up in amplitude as indicated in FIG. *2a*. In FIG. *2a*, the integrated output from the integral controller 15 is represented by sloped portions 20 whose inclination is determined by the rate of integration of the controller 15 and the direction of the slope is determined by the voltage polarity of the output from the comparator 12 depending upon whether the sensed oxygen concentration is above or below the reference setting level at which the air-fuel ratio is controlled. Voltage discontinuities 21 appearing in the waveform of FIG. *2a* are due to the linear amplification of the input signal and the direction of change in voltage at each discontinuity depends on the polarity of the output from the comparator 12. Thus, the combined output at the summation point 16 fluctuates between values above and below the setting level 22.

The combined output is applied to a second summation point 17 to which is also connected a train of bipolar pulses supplied from a pulse generator 18 or "Dither signal generator". The waveform of the pulses supplied from the generator 18 is illustrated in the form of rectangular pulses 23 of opposite polarities in FIG. *2b*. The summation at point 17 results in a waveform as shown in FIG. *2c* in which it is clearly shown that the voltage of the combined signal 25 intersects the setting level 22 as many times as the rectangular dither pulses 23 intersect zero voltage level 24. The output from the summation point 17 is applied to an air-fuel mixing and proportioning device 19.

As a result, the air-fuel mixture ratio is caused to vary to assume a value above or below the reference level or stoichiometry, i.e. it intersects the setting level as indicated by circles 26 in FIG. *2d* many times greater than it would otherwise intersect that level when controlled by the waveform of FIG. *2a*.

Since only one exhaust composition sensor is provided for a plurality of exhaust systems of the cylinders, the oxygen concentration represents a mean value of the concentrations reflecting the different stages of the piston strokes of the cylinders at a given instant of time. This averaging effect becomes increasingly pronounced as the frequency the pulsation increases and of resultant oxygen concentration follows a curve resembling the output from a low-pass filter in which the higher frequency components of an input signal applied thereto are more attenuated than the lower frequency components. Thus, the averaging effect of the embodiment serves to prevent the exhaust composition from becoming too rich or too lean.

A statistical analysis indicates that sampled values of the sensed oxygen concentration have a distribution characteristic such that a greater part of the sampled population falls within a small window of stoichiometric value.

The pulsating "Dither" signal may be a bipolar sawtooth wave or an alternating sinusoidal wave so far as the mean value of the bipolar signal is substantially zero.

A catalytic converter 20 is disposed in the exhaust passage of the engine 11 at the downstream side of the exhaust composition sensor 10. The catalytic converter 20 is preferably of a three-way catalyst type which provides simultaneous reduction of the noxious components NOx, HC and Co when the mixture is controlled at the desired setting point.

The concentration of the sampled air-fuel ratios within the stoichiometric window is enhanced by the parallel use of the proportional and integral controllers. Consider now the proportional controller with the assumption that no integral controller is provided. Since proportional control provides proportional amplification of a signal representing the sensed oxygen concentration above or below the stoichiometric value, the output signal will take the form of rectangular waveform, i.e. the signal is at one of two discrete values depending upon the input signal applied thereto. Therefore, the sampled control signal is either one of two control values and the sampled resultant air-fuel ratios will tend to concentrate in one of opposite extreme ends of a distribution. The linear integration, on the other hand, provides an output which linearly varies in amplitude with time in a direction depending upon whether the sensed oxygen concentration is above or below stoichiometry. Therefore, the sampled air-fuel ratio provides a uniform distribution characteristic.

The combined proportional and integral controller according to the invention provides a mixed control characteristic in which integral control contributes to the concentration of the sampled control signals within a narrow range as indicated in the broken lines 30 in FIG. *3b*, and proportional control contributes to the distribution of the sampled signals within a wider range of window as indicated in the broken lines 31. Therefore, the proportional-integral control signal has more chances of occurrence within a narrow range than the proportional or integral control signal alone has. This greater concentration of the control signal within a narrow range serves to concentrate the air-fuel distribution within a small stoichiometric window which corresponds to the broken lines 30.

The proportional-integral control principle plus the pulsation of control signal thus provides a distribution of air-fuel ratios as shown in FIG. *3a*.

The frequency of the Dither pulse from generator 18 may be controlled to vary in proportion to the engine speed as indicated by a connection 40 in FIG. 1, or synchronized with the engine crankshaft revolution. In this circumstance, the ratio of the frequency of the "Dither" pulse to the frequency of the output from the control circuit 13 is made substantially constant regardless of the engine speed.

Figure 4:
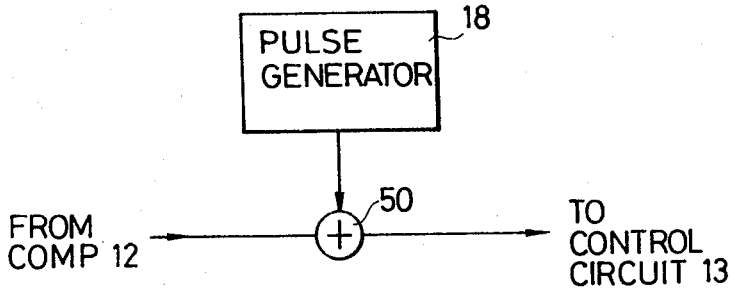
FIG. 4 is a modification of the embodiment of FIG. 1.

It is to be noted that the pulse generator 18 may be connected to a summation point 50 as shown in FIG. 4 to modulate the output from the comparator 12 rather than to the summation point 17 at the output of the control circuit 13.

What is claimed is:

1. Emission control apparatus for a multi-cylinder internal combustion engine having an exhaust passage in common to the cylinders of the engine, comprising:

exhause composition sensing means disposed in said exhaust passage for sensing the concentration of a composition of exhaust emissions from said cylinders, and providing an output signal representative thereof;

means responsive to said output signal for generating a control signal representative of said sensed concentration, said control signal generating means comprising means for comparing said output signal from said exhaust composition sensing means to a predetermined value, outputting a first signal indicative of said output signal being higher than said predetermined value, and outputting a second signal indicative of said output signal being below said predetermined value, and means for integrating said first and second signals to obtain said control signal;

means for generating a bipolar pulsating signal having substantially equal amplitudes of opposite polarity at a frequency higher than the frequency at which said sensed concentration fluctuates;

means for combining said control signal with said pulsating signal to obtain a combined signal with frequency higher than said control signal; and means for mixing and proportioning air and fuel supplied to said cylinders in response to said combined signal;

whereby said means for mixing and proportioning is feedback controlled with a resultant fluctuation of said sensed concentration of said exhaust composition.

2. A method of controlling the exhaust emissions of a multi-cylinder internal combustion engine, comprising the steps of:

(a) sensing the concentration of a composition of said exhaust emissions from said cylinders and producing a concentration signal representative of said concentration;

(b) generating a control signal representative of said sensed concentration by comparing said concentration signal with a limit value and outputting a resultant signal indicative of said comparison, and integrating said resultant signal to obtain said control signal;

(c) generating a bipolar pulsating signal having substantially equal amplitudes of opposite polarity at a frequency higher than the frequency at which said sensed concentration fluctuates;

(d) obtaining a combined signal with a frequency higher than said control signal by combining said control signal with said pulsating signal; and (e) mixing and proportioning air and fuel supplied to said cylinders in response to said combined signal.

3. An emission control apparatus for a multi-cylinder internal combustion engine having an exhaust passage, comprising:

sensing means for sensing the concentration of a constituent of exhaust emissions from said cylinders and providing an output signal representative thereof;

control signal generating means for comparing said output signal with a reference level signal and producing a control signal which varies with time and has monotonically increasing and monotonically decreasing portions in response to said comparison;

means for generating a bipolar signal having substantially equal amplitudes of opposite polarity at a frequency higher than the frequency at which said sensed concentration fluctuates;

means for combining said control signal with said bipolar signal to obtain a combined signal with a frequency higher than said control signal and such that at least some of said monotonically increasing and decreasing portions have portions which extend above and below said reference level with varying amplitudes; and means for mixing and proportioning air and fuel supply to said cylinders in response to said combined signal;

whereby the air fuel mixture of said internal combustion engine is caused to vary to assume values above and below the reference level at a relatively high rate compared to the frequency at which said sensed concentration fluctuates.

4. The emission control apparatus of claim 1, wherein said pulsating signal generating means compriss means for proportionally relating said higher frequency to the speed of said engine.

5. The emission control apparatus of claim 1, wherein said combining means is connected to the output of said comparing means.

6. The emission control apparatus of claim 1, wherein said control signal generating means further comprises:

means for providing proportional modification of the amplitude of the output from said comparing means; and means for summing the outputs from said proportional modification means and said integrating means.

7. The emission control apparatus of claim 1, wherein said comparing means includes limit circuit means for causing said first signal to assume a first predetermined value and causing said second signal to assume a second predetermined value.

8. The method of claim 2, wherein the step of generating a control signal includes causing said resultant signal to assume a first predetermined value when said concentration signal is greater than said limit value and producing a second predetermined value signal when said concentration signal is less than said limit value.

* * * * *